US007833362B2

(12) United States Patent
Brown et al.

(10) Patent No.: US 7,833,362 B2
(45) Date of Patent: Nov. 16, 2010

(54) METHOD FOR IMPROVING CREEP RESISTANCE AND LOW CYCLE FATIGUE PROPERTIES OF PRESSURE-CONTAINING COMPONENTS

(75) Inventors: Mark Roger Brown, Greenville, SC (US); Thomas Robbins Tipton, Jupiter, FL (US); Liming Xu, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 151 days.

(21) Appl. No.: 12/235,054

(22) Filed: Sep. 22, 2008

(65) Prior Publication Data

US 2009/0007995 A1 Jan. 8, 2009

Related U.S. Application Data

(62) Division of application No. 10/905,145, filed on Dec. 17, 2004, now abandoned.

(51) Int. Cl.
*C21D 5/00* (2006.01)
*C22C 37/10* (2006.01)

(52) U.S. Cl. ..... 148/614; 148/618; 148/321; 420/27

(58) Field of Classification Search ..... 148/612–618, 148/321; 420/13–33
See application file for complete search history.

(56) References Cited

U.S. PATENT DOCUMENTS 2,809,888 A * 10/1957 Eash et al. ..... 420/26

FOREIGN PATENT DOCUMENTS

JP 60-29420 * 2/1985

OTHER PUBLICATIONS

English-hand translation of Japanese patent 60-29420, Shiro Nakamura et al., Feb. 14, 1985.*

* cited by examiner

*Primary Examiner*—Deborah Yee
(74) *Attorney, Agent, or Firm*—Hartman & Hartman, P.C.; Gary M. Hartman; Domenica N. S. Hartman

(57) ABSTRACT

A method by which high temperature properties of a ductile iron alloy, including creep and LCF properties, can be increased for pressure-containing components that are subject to creep and low cycle fatigue. The method comprises modifying the ductile iron alloy to contain 0.4 to 0.8 weight percent molybdenum. A casting of the modified ductile iron alloy is produced and then annealed at a temperature of at least 725° C. for not less than five hours to eliminate carbides and/or stabilize pearlite in the casting. The annealed casting of the modified ductile iron alloy exhibits improved creep resistance and low cycle fatigue properties in comparison to an identical casting of a ductile iron alloy that does not contain molybdenum.

19 Claims, 2 Drawing Sheets

METHOD FOR IMPROVING CREEP RESISTANCE AND LOW CYCLE FATIGUE PROPERTIES OF PRESSURE-CONTAINING COMPONENTS

CROSS REFERENCE TO RELATED APPLICATIONS

This is a division patent application of U.S. patent application Ser. No. 10/905,145, filed Dec. 17, 2004 now abandoned.

BACKGROUND OF THE INVENTION

The present invention generally relates to ductile iron alloys. More particularly, this invention relates to modifying a ductile iron alloy to exhibit desirable properties for turbine compressor case components that must operate at temperatures exceeding the capability of conventional ductile iron alloys.

Various alloys have been considered and used for compressor discharge cases and compressor case and other high-temperature components of industrial gas turbines. Compressor discharge cases are generally located immediately downstream from the compressor of a gas turbine, while compressor cases are still farther downstream and connect compressor discharge cases with the first stage of the turbine section. Because of the high pressures and elevated temperatures sustained between the compressor and turbine sections, alloys suitable for the compressor discharge cases and compressor cases (for convenience, referred to herein simply as compressor cases) require good creep, rupture, tensile, and low cycle fatigue (LCF) properties.

Ductile iron (cast nodular iron) alloys have been developed for various structural applications within turbomachinery and elsewhere due to their strength, toughness, and machinability. As a particular example, the ferritic ductile alloy ASTM A395/A395M-99 has found use as the alloy for pressure-containing structural components used at elevated temperatures, including compressor cases for industrial gas turbines. The ASTM A395/A395M-99 alloy is specified as having a composition of, by weight, at least 3.0% carbon, up to about 2.5% silicon, and up to 0.08% phosphorous, the balance iron and incidental impurities. The ASTM A395/A395M-99 alloy is the current material used in the manufacture of compressor cases for B, F, and E-class technology gas turbines produced by the General Electric Company, such as the MS6001B, MS7001FA, MS7001FB, and MS9001E gas turbine models. Based on the ASTM specification, compressor cases cast from the A395/A395M-99 alloy should be capable of withstanding operating temperatures of up to about 650° F. (about 345° C.). However, as gas turbines are upgraded to promote their performance and efficiency, so do the temperatures and loads that compressor cases must sustain. With such upgrades, additional temperature and stress capability are required as a result of increased pressure ratios and firing temperatures.

The alloying of ductile irons to contain greater amounts of silicon, e.g., about 4 to 6 weight percent, alone or combined with up to about 2 weight percent molybdenum, is known for obtaining higher strengths at high operating temperatures.

However, it has been reported that these alloys can exhibit reduced ductility at ambient temperatures, reduced castability, and reduced machinability.

BRIEF DESCRIPTION OF THE INVENTION

The present invention provides a method by which high temperature properties of a ductile iron alloy, including creep, rupture, tensile, and LCF properties, can be significantly increased over the conventional ASTM A395/A395M-99 alloy. The method is particularly suitable for pressure-containing components that are located between the compressor and turbine sections of gas turbines, and therefore are subject to creep and low cycle fatigue. The method comprises modifying the ductile iron alloy to additionally contain 0.4 to 0.8 weight percent molybdenum and permit an increased silicon content of up to 2.75 weight percent, wherein the balance of the modified ductile iron alloy is iron and incidental impurities of, by weight, up to 0.3% manganese, up to 0.1% chromium, up to about 0.05% magnesium, up to 0.08% phosphorus, and up to 0.01% sulfur. A casting of the modified ductile iron alloy is produced and then annealed at a temperature of at least 725° C. for not less than five hours to eliminate carbides and/or stabilize pearlite in the casting. The annealed casting of the modified ductile iron alloy exhibits improved creep resistance and low cycle fatigue properties in comparison to an identical casting of the conventional ductile iron alloy.

The modified ductile iron alloy is well suited to form cast compressor discharge cases and cast compressor cases of industrial gas turbines, and particularly gas turbines whose compressor cases are subjected to operating temperatures of 400° C. and above. As such, the modified ductile iron alloy exceeds the high temperature capabilities of the conventional ASTM A395/A395M-99 alloy.

Other objects and advantages of this invention will be better appreciated from the following detailed description.

DETAILED DESCRIPTION OF THE INVENTION

Figure 1:
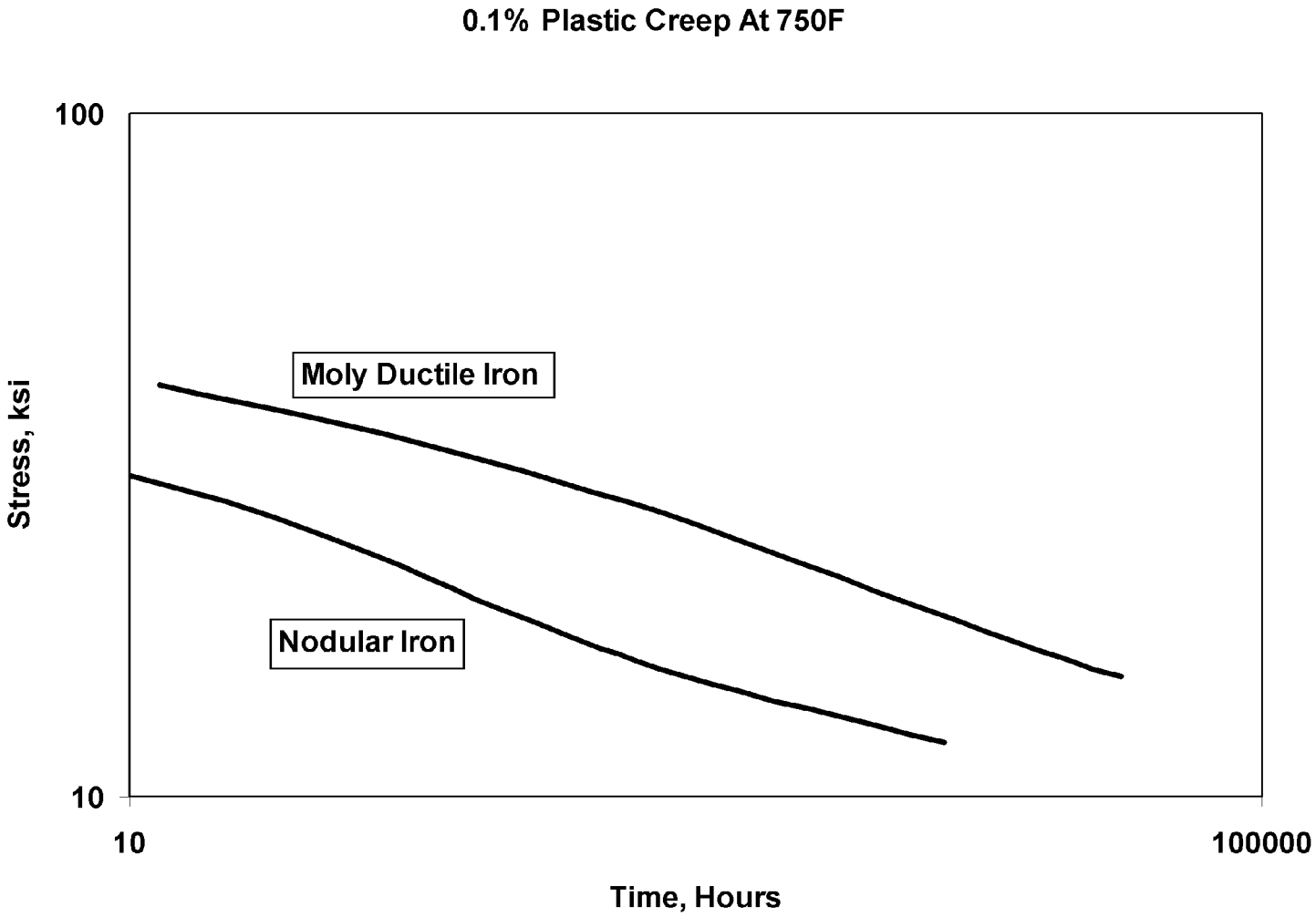
FIGS. 1 and 2 are graphs plotting 0.1% creep life and low cycle fatigue life, respectively, comparing conventional ductile (nodular) iron alloys with molybdenum-containing ductile iron alloys within the scope of the present invention.

The present invention provides a ductile iron alloy that exhibits excellent high temperature properties of the type required by compressor cases of industrial gas turbines. The alloy of this invention preferably contains the following elements in the following approximate proportions based on weight percent: 3.0% minimum carbon, 2.75% maximum silicon, 0.40% to 0.80% molybdenum, 0.3% maximum manganese, 0.1% maximum chromium, 0.08% maximum phosphorus, 0.01% maximum sulfur, and the balance iron and incidental impurities.

The levels of carbon, silicon and molybdenum are primarily responsible for obtaining the desired high temperature properties of the alloy. The role of silicon is generally to promote the strength, hardness, hardenability, and corrosion resistance of the base iron. Silicon levels above 2.75 weight percent are undesirable for use as a cast compressor case from the standpoint of reduced room temperature ductility, reduced castability, and reduced machinability. The ASTM A395/A395M-99 specification allows an increase of 0.08% silicon above 2.5% up to a maximum of 2.75% for each reduction of 0.01% phosphorus below the maximum specified phosphorous content (all percentages are by weight). In accordance, while a silicon content of up to 2.75 weight percent is permissible in the alloy of this invention, a more restrictive upper silicon limit is 2.5 weight percent for the alloy as its phosphorous content approaches 0.08 weight percent. As with conventional ductile iron alloys, the carbon content of the alloy separates as spheroidal graphite during cooling, primarily as the result of the presence of silicon. The spheroidal graphite imparts such desirable properties as high strength and toughness for which ductile iron alloys are known. The limited range of molybdenum employed by the invention is believed to promote hardening and improve corrosion resistance and high temperature strength and creep resistance.

Chromium may be added in the above-noted amounts to promote the strength of the alloy by promoting the formation of carbides, impart corrosion resistance, and stabilize the alloy microstructure at high temperatures. Manganese serves to scavenge sulfur, which is preferably absent from the alloy but is usually unavoidably present as an impurity. Phosphorus is also an impurity that is kept at levels as low as possible.

In order to optimize mechanical properties, the alloy should undergo heat treatment to eliminate carbides and/or stabilize pearlite. In the preferred embodiment in which the alloy is cast to form a compressor case, the alloy is cast in accordance with conventional practice for the ASTM A395/A395M-99 alloy, after which the casting is preferably annealed at a temperature of at least about 1340° F. (about 725° C.) for about one hour for every inch of maximum casting thickness, but not less than five hours.

Various specimens having chemistries set forth in Table I below were melt and cast in accordance with the current published ASTM A395/A395M-99 specification, whose disclosure relating to the processing of ASTM A395/A395M-99 alloys is incorporated herein by reference. TC is total carbon. Magnesium was present in the alloys in amounts considered to be allowable impurity levels.

TABLE I

| Alloy | TC | Si | Mo | Mn | Mg | P | S |
|---|---|---|---|---|---|---|---|
| Melt 1 | 3.62 | 2.62 | 0.41 | 0.11 | 0.055 | 0.016 | 0.010 |
| Melt 2 | 3.64 | 2.50 | 0.43 | 0.11 | 0.056 | 0.017 | 0.008 |
| Melt 3 | 3.55 | 2.66 | 0.43 | 0.09 | 0.053 | 0.016 | 0.010 |

Figure 2:
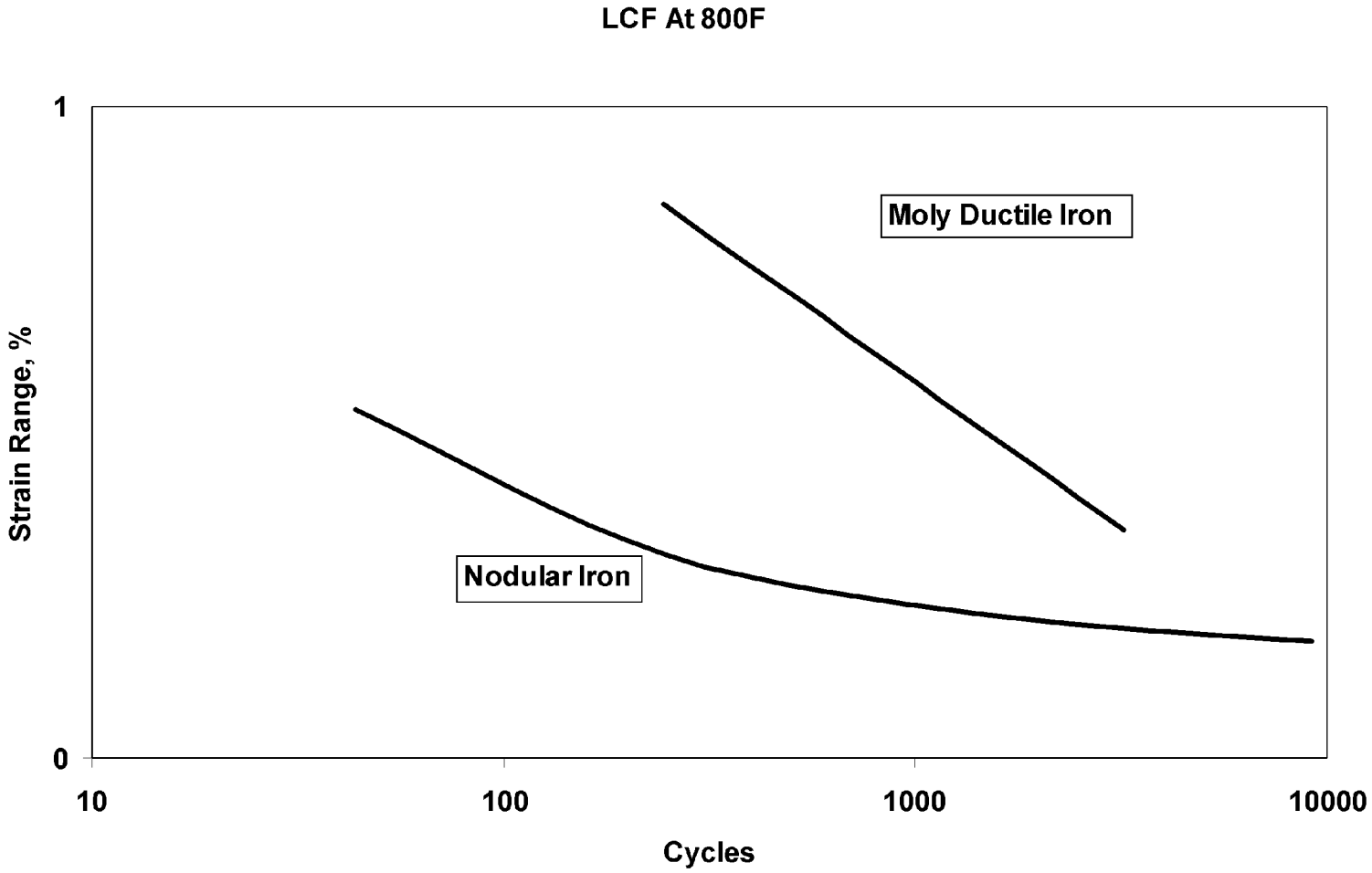

Each cast specimen underwent a heat treatment cycle that included a soak temperature of about 760° C. for about sixteen hours, followed by slow cooling to room temperature. Following heat treatment, some of the specimens underwent creep testing at about 550° F. (about 290° C.), about 650° F. (about 345° C.), about 750° F. (about 400° C.), about 850° F. (about 454° C.), or about 950° F. (about 510° C.). FIG. 1 is a 0.1% creep curve plotted for those specimens tested at 750° F., and evidences that the creep properties of the alloys ("Moly Ductile Iron") were at least twenty times greater than the conventional ASTM A395/A395M-99 alloy ("Nodular Iron") tested under the same conditions. Other specimens underwent low cycle fatigue (LCF) testing, the results of which are plotted in FIG. 2 and evidence that the LCF properties of the alloys ("Moly Ductile Iron") were at least ten times greater than the conventional ASTM A395/A395M-99 alloy ("Nodular Iron") when tested under the same conditions. In view of the increased creep and LCF properties exhibited by the specimens having chemistries within the scope of this invention, it was concluded that their alloys would perform well as cast compressor cases in the operating environments of E-class gas turbines produced by General Electric, such as the MS9001E model, as well as other gas turbines with components requiring additional temperature and stress capability as a result of increased pressure ratios and firing temperatures.

While the invention has been described in terms of a preferred embodiment, it is apparent that other forms could be adopted by one skilled in the art. Therefore, the scope of the invention is to be limited only by the following claims.

The invention claimed is:

1. A method for improving creep resistance and low cycle fatigue properties of a pressure-containing component that is located between a compressor section and a turbine section of a gas turbine, has been cast from a conventional ductile iron alloy containing, by weight, at least 3% carbon, up to about 2.5% silicon, and up to 0.08% phosphorus, the balance iron and incidental impurities, and is subject to creep and low cycle fatigue when installed in the gas turbine, the method comprising:

modifying the ductile iron alloy to additionally contain molybdenum and permit an increased silicon content wherein the modified ductile iron alloy consists of, by weight, about at least 3% carbon, up to 2.75% silicon, 0.4 to 0.8% molybdenum, and the balance of the modified ductile iron alloy is iron and incidental impurities of, by weight, up to 0.11% manganese, up to 0.1% chromium, up to about 0.05% magnesium, up to 0.08% phosphorus, and up to 0.01% sulfur;

producing a casting of the modified ductile iron alloy; and then performing a heat treatment process by annealing the casting at a temperature of at least 725° C. for not less than five hours to eliminate carbides and/or stabilize pearlite in the casting;

wherein the heat-treated casting of the modified ductile iron alloy exhibits improved creep resistance and low cycle fatigue properties in comparison to an identical casting of the conventional ductile iron alloy.

2. The method according to claim 1, wherein the modified ductile iron alloy contains, by weight, about 3.6% carbon, about 2.6% silicon, about 0.4% molybdenum, and 0.1% manganese.

3. The method according to claim 1, wherein the pressure-containing component has an upper operating temperature of at least 400° C.

4. The method according to claim 1, further comprising the step of installing the pressure-containing component in an industrial gas turbine.

5. The method according to claim 4, wherein the pressure-containing component is a compressor discharge case located immediately downstream of the compressor section of the gas turbine.

6. The method according to claim 4, wherein the pressure-containing component is located downstream of a compressor discharge case of the gas turbine.

7. The method according to claim 1, wherein the casting is annealed for about one hour for every inch of maximum thickness of the casting.

8. A method for improving creep resistance and low cycle fatigue properties of a pressure-containing component that is located between a compressor section and a turbine section of a gas turbine, has been cast from a conventional ductile iron alloy containing, by weight, at least 3% carbon, up to about 2.5% silicon, and up to 0.08% phosphorus, the balance iron and incidental impurities, and is subject to creep and low cycle fatigue when installed in the gas turbine, the method comprising:

modifying the ductile iron alloy to additionally contain molybdenum and permit an increased silicon content wherein the modified ductile iron alloy consists of, by weight, about at least 3% carbon, up to 2.75% silicon, 0.4 to 0.8% molybdenum, and the balance of the modified ductile iron alloy is iron and incidental impurities of, by weight, up to 0.3% manganese, up to 0.1% chromium, up to about 0.05% magnesium, up to 0.08% phosphorus, and up to 0.01% sulfur;

producing a casting of the modified ductile iron alloy;

performing a heat treatment process consisting of annealing the casting at a temperature of at least 725° C. for not less than five hours to eliminate carbides and/or stabilize pearlite in the casting and thereby yield a heat-treated pressure-containing component; and then installing the heat-treated pressure-containing component in an industrial gas turbine;

wherein the heat-treated pressure-containing component of the modified ductile iron alloy exhibits improved creep resistance and low cycle fatigue properties in comparison to an identical casting of the conventional ductile iron alloy.

9. The method according to claim 8, wherein the modified ductile iron alloy contains, by weight, about 3.6% carbon, about 2.6% silicon, about 0.4% molybdenum, and 0.1% manganese.

10. The method according to claim 8, wherein the pressure-containing component has an upper operating temperature of at least 400° C.

11. The method according to claim 8, wherein the pressure-containing component is a compressor discharge case located immediately downstream of the compressor section of the gas turbine.

12. The method according to claim 8, wherein the pressure-containing component is located downstream of a compressor discharge case of the gas turbine.

13. The method according to claim 8, wherein the casting is annealed for about one hour for every inch of maximum thickness of the casting.

14. The method according to claim 1, wherein the incidental impurities consist of manganese, chromium, magnesium, phosphorus and sulfur.

15. The method according to claim 1, wherein the heat treatment process consists of the annealing of the casting.

16. The method according to claim 1, wherein the casting is annealed at a temperature of 725° C. to 760° C.

17. The method according to claim 8, wherein the incidental impurities consist of manganese, chromium, magnesium, phosphorus and sulfur.

18. The method according to claim 8, wherein the modified ductile iron alloy contains up to 0.11% manganese.

19. The method according to claim 8, wherein the casting is annealed at a temperature of 725° C. to 760° C.

* * * * *